US008183324B2

(12) United States Patent
Yamato et al.

(10) Patent No.: US 8,183,324 B2
(45) Date of Patent: May 22, 2012

(54) ANTISTATIC ACRYLIC FIBER AND A METHOD FOR MANUFACTURING THE SAME

(75) Inventors: Yoshiki Yamato, Okayama (JP); Yoshihiro Watanabe, Okayama (JP)

(73) Assignee: Japan Exlan Company Limited, Osaka (JP)

( * ) Notice: Subject to any disclaimer, the term of this patent is extended or adjusted under 35 U.S.C. 154(b) by 48 days.

(21) Appl. No.: 12/918,161

(22) PCT Filed: Jun. 19, 2009

(86) PCT No.: PCT/JP2009/002798

§ 371 (c)(1), (2), (4) Date: Aug. 18, 2010

(87) PCT Pub. No.: WO2010/007728

PCT Pub. Date: Jan. 21, 2010

(65) Prior Publication Data

US 2010/0324221 A1 Dec. 23, 2010

(30) Foreign Application Priority Data

Jul. 16, 2008 (JP) ..... 2008-185260

(51) Int. Cl.

| | |
|---|---|
| ***C08F 8/00*** | (2006.01) |
| ***C08L 33/02*** | (2006.01) |
| ***C08L 33/04*** | (2006.01) |
| ***C08L 33/18*** | (2006.01) |
| ***C08L 33/20*** | (2006.01) |
| ***C08L 35/02*** | (2006.01) |

(52) U.S. Cl. ..... 525/238; 525/196; 525/221; 525/222

(58) Field of Classification Search ..... 525/238, 525/196, 221, 222

See application file for complete search history.

(56) References Cited

U.S. PATENT DOCUMENTS 3,868,816 A * 3/1975 Saji et al. ..... 57/254

FOREIGN PATENT DOCUMENTS

| | | |
|---|---|---|
| JP | 60-2778 | 1/1985 |
| JP | 61-47873 | 3/1986 |
| JP | 63-211316 | 9/1988 |
| JP | 8-325832 | 12/1996 |
| JP | 8-337925 | 12/1996 |
| JP | 931747 | 2/1997 |
| JP | 9-78377 | 3/1997 |
| JP | 2003-342831 | 12/2003 |

OTHER PUBLICATIONS

International Search Report issued Oct. 6, 2009 in International (PCT) Application No. PCT/JP2009/002798.

* cited by examiner

*Primary Examiner* — Nathan M Nutter

(74) *Attorney, Agent, or Firm* — Wenderoth, Lind & Ponack, L.L.P.

(57) ABSTRACT

The present invention is an antistatic acrylic fiber which comprises 90 to 99% by weight of acrylonitrile polymer containing 80 to 100% by weight of acrylonitrile as a constituting component and 10 to 1% by weight of acrylic antistatic resin containing 10 to 70% by weight of acrylonitrile as a constituting component, characterized in that alkali metal ion is contained in the fiber in an amount of not less than 150 ppm. The acrylic fiber of the present invention has antistatic property which does not lower so much even if the fiber is subjected to a spinning and dyeing step.

11 Claims, No Drawings

ANTISTATIC ACRYLIC FIBER AND A METHOD FOR MANUFACTURING THE SAME

TECHNICAL FIELD OF THE INVENTION

The present invention relates to an antistatic acrylic fiber having excellent processability and durability which can be used for various uses such as in clothing, bedclothes or interior uses and also to a method for manufacturing the same.

BACKGROUND ART

Acrylic fiber has excellent properties in heat retention, form stability, light resistance, texture, dyeing, etc. and, due to its excellent physical properties and easy-care property, which are not available in the natural fibers, it has been widely utilized in clothing and interior use. However, the acrylic fiber as such still has some problems such as, due to its poor hygroscopicity, static electricity is apt to be generated by friction, dust is apt to stick to the clothing by electrostatic force and unpleasant feeling is noted due to the discharge of electrostatic force upon putting on and taking off the clothing. Various attempts have been already conducted up to now for solving the problems above. The most common attempt is a method where an oiling agent having antistatic property is applied on the fiber surface but, in this method, although an excellent antistatic property is available in the fiber's initial stage, the antistatic property lowers significantly by dyeing, repeated bleaching, washing, etc. of the fiber. As an example of an attempt for achieving a fiber having durable antistatic property, there is proposed in Patent Document 1 a method of spinning an acrylonitrile copolymer prepared by copolymerization of a vinyl monomer having a glyoxyl group. However, it is essential in such a method that the acrylonitrile copolymer is copolymerized with another specific monomer, whereby complexity in the polymerizing operation is unable to be avoided and, moreover, due to copolymerization of a monomer having a strong hydrophilic property, such copolymer is apt to be eluted during a spinning step, particularly during the steps of coagulating to water washing, and the contamination of the solvent to be recovered and reused is significant.

There is also proposed a method where fine particles having electrical conductivity, such as electroconductive carbon and other metal compounds are kneaded into fiber to prepare a so-called electroconductive fiber. For example, there is proposed a method in Patent Document 2 of a solution of acrylonitrile copolymer in an organic solvent, wherein carbon black is dispersed and contained, and a spinning dope of an acrylonitrile copolymer is mixed and spun. However, due to the use of carbon, the fiber prepared by such a method is black or gray in color, whereby the useful range of the fiber such as in clothing and interior use is significantly restricted. In Patent Document 3, there is proposed a method where an electroconductive acrylic fiber is prepared by a core-sheath complex spinning method using an electroconductive substance having an electric conductivity of not less than $10^{-3}$ S/cm but, since a core-sheath spinning apparatus having a complicated shape is necessary for this method, problems such as high cost for the equipment and significant lowering of productivity arises. In Patent Document 4, there is proposed a method where alkali metal salt and water are added to a mixture of acrylonitrile copolymer and acrylonitrile antistatic polymer, followed by dissolving the mixture in an organic solvent and the resulting spinning dope is spun. Although the half-life of the woven product comprising the fiber prepared by such a method is long, the product is insufficient as an antistatic fiber. Moreover, in accordance with such a method, there is a problem that the alkali metal ion is ionically bound to the dyeing site and is easily detached during a step of spinning and washing with water or during a step of dyeing.

REFERENCES

Patent Document 1: Japanese Patent Application Laid-Open (JP-A) No. 325832/96

Patent Document 2: Japanese Patent Application Laid-Open (JP-A) No. 31747/97

Patent Document 3: Japanese Patent Application Laid-Open (JP-A) No. 337925/96

Patent Document 4: Japanese Patent Application Laid-Open (JP-A) No. 211316/88

DISCLOSURE OF THE INVENTION

Problem that the Invention is to Solve

An object of the present invention is to solve the above-mentioned problems in the prior art, to provide an antistatic acrylic fiber where the antistatic property is excellent, and even if the fiber is subjected to a spinning and dyeing step, the antistatic property does not substantially lower and to provide a fiber structure, which at least partially contains an antistatic acrylic fiber. An object of the present invention is also to provide a method for the manufacture of such an antistatic acrylic fiber having no complexity in the production steps, while maintaining high productivity.

Means for Solving the Problem

The present inventors have carried out intensive studies for achieving the above objects and completed the present invention.

Thus, the present invention relates to an antistatic acrylic fiber which comprises 90 to 99% by weight of acrylonitrile polymer containing 80 to 100% by weight of acrylonitrile as a constituting component and 10 to 1% by weight of acrylic antistatic resin containing 10 to 70% by weight of acrylonitrile as a constituting component, wherein alkali metal ion is contained in the fiber in an amount of not less than 150 ppm.

Preferred embodiments of the antistatic acrylic fiber of the present invention are as follows.

(i) Volume resistivity is from $10^3$ to $10^6$ Ω·cm.

(ii) The acrylic antistatic resin is an acrylic polymer containing 90 to 30% by weight of the copolymerizing component represented by the following formula [I] as a constituting component, and the alkali metal ion is lithium ion:

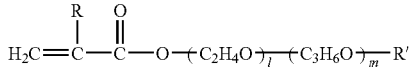

[I]

wherein R is hydrogen atom or alkyl group having 1 to 5 carbon(s); R' is hydrogen atom, alkyl group having 1 to 18 carbon(s), phenyl group derivative thereof; $15<l<50$; and $0 \leqq m<l$.

(iii) The alkali metal ion retentive rate of the fiber after being dyed with cationic dye to the rate before being dyed is not less than 40%.

(iv) The alkali metal ion content to the fiber after being dyed with cationic dye is not less than 80 ppm.

The present invention also relates to an antistatic fiber structure, which is characterized by at least partially containing the above-mentioned antistatic acrylic fiber.

In a preferred embodiment of the antistatic fiber structure of the present invention, after being dyed with cationic dye, the half-life of the friction-charged electrostatic potential is not more than 3 seconds and the friction-charged electrostatic potential is not more than 2 kV.

The present invention also relates to a method for the manufacture of an antistatic acrylic fiber, characterized in that a spinning dope containing a polymer mixture which comprises 90 to 99% by weight of acrylonitrile polymer containing 80 to 100% by weight of acrylonitrile as a constituting component, and 10 to 1% by weight of acrylic antistatic resin containing 10 to 70% by weight of acrylonitrile as a constituting component, is subjected to wet spinning and, after the resulting fiber is washed with water and drafted, it is treated with an aqueous solution of alkali metal salt and then densified.

Preferred embodiments of the method for the manufacture of an antistatic acrylic fiber of the present invention are as follows.

(i) Water content of the un-dried fiber after being washing with water and drafted is 50 to 130% by weight and a thermal treatment is conducted at the temperature of 100 to 130° C. between the treatment of washing with water and being drafted and the treatment with an aqueous solution of alkali metal salt.

(ii) The densification treatment is conducted under tension.

(iii) The densification treatment is conducted in a wet state.

Advantages of the Invention

In accordance with the present invention, an antistatic acrylic fiber having excellent antistatic property and durability thereof is able to be provided by a simple and effective method. When the antistatic acrylic fiber is contained at least partially, it is possible to provide a fiber structure having excellent antistatic property.

BEST MODE FOR CARRYING OUT THE INVENTION

Firstly, the antistatic acrylic fiber of the present invention will be illustrated.

With regard to the acrylonitrile polymer used in the present invention, a conventionally known acrylic fiber may be used, although it is essential that it contains 80 to 100% by weight, preferably 88 to 100% by weight of acrylonitrile as a constituting component. When the content of the acrylonitrile does not satisfy the above range, there is a possibility that introduction of alkali metal ion to the inside of the fiber, discussed later, becomes difficult.

With regard to the constituting component other than acrylonitrile in the above acrylonitrile polymer, anything may be used so far as it is a vinyl compound, and representative examples thereof include acrylic acid, methacrylic acid or esters thereof; acrylamide, methacrylamide or N-alkyl substituted substances thereof; vinyl ester such as vinyl acetate; halogenated vinyl or vinylidene substance such as vinyl chloride, vinyl bromide or vinylidene chloride; and unsaturated sulfonic acid such as vinylsulfonic acid, allylsulfonic acid, methallylsulfonic acid or p-styrenesulfonic acid as well as salts thereof. As to the above acrylonitrile polymer, plural species thereof may also be used as the constituting components provided that the above-mentioned requirements are still satisfied.

The resin which constitutes the antistatic acrylic fiber of the present invention preferably contains an anionic group such as sulfonic acid group or carboxylic acid group. That is because the resin is preferably dyeable with cationic dyes, as in the case of many acrylic fibers. Examples of a method for making a polymer containing anionic group include a method where acrylonitrile is copolymerized with a monomer containing the anionic group (i.e., an anionic ion-containing monomer), and a method where acidic sulfite is used as a redox catalyst in the polymerization of acrylonitrile or, particularly, as a reducing agent so as to introduce an anionic group such as sulfonic acid group into a terminal end of the polymer.

The acrylic antistatic resin used in the present invention is an organic polymer compound containing abundant ether oxygen, such as polyalkylene oxide chain, polyether amide chain or polyether ester chain. It is necessary that the acrylic antistatic resin contains 10 to 70% by weight, preferably 15 to 50% by weight, and more preferably 15 to 30% by weight of acrylonitrile as a constituting component. When the content of acrylonitrile is less than the above range, its compatibility with the above acrylonitrile polymer becomes bad, which causes deterioration in the mechanical properties of the fiber due to a phase separation. Further, since the alkali metal ion contained in the fiber of the present invention is held in the inner area of the fiber by means of a coordination bond with the ether oxygen in the resin for achieving antistatic property, there is a possibility that the alkali metal ion is not held well, but is eluted out from the inner area of the fiber, whereby no sufficient antistatic property is available if the content of acrylonitrile is more than the above range.

Examples of a method by which abundant ether oxygen is contained in the above acrylic antistatic resin include a method where acrylonitrile is copolymerized with a vinyl monomer and ether oxygen is integrated on a side chain, and a method where acrylonitrile is copolymerized with a vinyl monomer containing reactive functional groups and then a reactive compound containing ether oxygen is subjected to a graft reaction. As to a vinyl monomer in the former method, it is preferred to use 30 to 90% by weight, more preferably 50 to 85% by weight, and further preferably 70 to 85% by weight of the monomer represented by the above formula [I]. In copolymerizing with acrylonitrile, an other vinyl compound than the above vinyl monomer may be copolymerized as well. As an example thereof, it is recommended to use, for example, a small amount of a cross-linking monomer to adjust the degree of swelling of the resin with water, which will be mentioned later.

Examples of the above-mentioned vinyl monomer where ether oxygen is integrated on the side chain include a reaction product of 2-methacryloyloxyethyl isocyanate with polyethylene glycol monomethyl ether and examples of the monomer represented by the formula [I] include methoxypolyethylene glycol (30 mole) methacrylate, methoxypolyethylene glycol (30 mole) acrylate and polyethylene glycol-2,4,6-tris-1-phenylethyl phenyl ether methacrylate (number-average molecular weight of about 1600). Examples of the vinyl monomer having a reactive functional group in the latter method include 2-hydroxyethyl methacrylate, acrylic acid, methacrylic acid, N-hydroxymethyl acrylamide, N,N-dimethylaminoethyl methacrylate, glycidyl methacrylate and 2-methacryloyloxyethyl isocyanate and examples of the reactive compound having ether oxygen include polyethylene glycol monomethyl ether and polyethylene glycol monomethacrylate.

It is preferred in achieving the object of the present invention that the acrylic antistatic resin has a degree of swelling with water of 10 to 300 g/g, preferably 20 to 150 g/g and has a physical property that it is not soluble in water or a solvent for acrylonitrile polymer, but is able to be finely dispersed in the solvent. Various methods are able to be used for adjusting the degree of swelling with water and examples thereof include a method where a cross-linking monomer is copolymerized as mentioned already and a method where the value of 1 or m of the monomer represented by the formula [I] is changed.

There is no particular limitation for the synthesis method of the acrylonitrile polymer but a publicly known polymerization means such as suspension polymerization, emulsification polymerization or solution polymerization may be used. The same polymerizing method may also be used as a method for the synthesis of an acrylic antistatic resin, and depending upon the cases, it is also possible to use a graft reaction for the introduction of ether oxygen as mentioned above.

With regard to the amount of the acrylonitrile polymer and the acrylic antistatic resin in the antistatic acrylic fiber of the present invention, it is necessary to make the acrylonitrile polymer and the acrylic antistatic resin 90 to 99% by weight and 10 to 1% by weight, respectively. When the range is outside the above, problems in the manufacture of the fiber such as clogging of the nozzle during the spinning or end breakage may result.

In order to achieve a sufficient antistatic property, it is necessary that not less than 150 ppm, preferably not less than 180 ppm, and more preferably not less than 200 ppm of alkali metal ion remains in the inner area of the antistatic acrylic fiber of the present invention. However, when the alkali metal ion is too much, the amount which reacts with the dyeing site becomes large, whereby there is a risk of reduction in the dyeing property and, accordingly, the amount is preferably not more than 500 ppm. Volume resistivity of the antistatic acrylic fiber of the present invention is preferred to be $10^3$ to $10^6$ Ω·cm. When it is within such a range, a sufficient antistatic property is able to be achieved.

Further, in order to achieve a sufficient antistatic property in the antistatic acrylic fiber of the present invention, the alkali metal ion retentive rate of the fiber after being dyed with cationic dye when compared to the rate before being dyed is preferably not less than 40%, more preferably not less than 50%, and further preferably not less than 55%. The absolute amount of the alkali metal ion to the fiber after being dyed is preferably not less than 80 ppm, more preferably not less than 100 ppm, and more preferably not less than 150 ppm. As to the alkali metal ion used in the present invention, Li, Na or K is preferred and lithium ion having a small ionic radius is particularly preferred. As to a salt of the alkali metal, that having a high dissociation in water may be used and preferred ones thereof are perchlorate, carbonate and peroxide salt, and particularly preferable, perchlorate.

Secondly, the method for the manufacture of an antistatic acrylic fiber of the present invention will be illustrated.

In the antistatic acrylic fiber of the present invention, it is necessary that alkali metal ion is contained in the fiber and it is preferred that as much of alkali metal ion as possible is localized in the acrylic antistatic resin. It is also preferred that after the alkali metal ion is contained, voids existing in the fiber are made as little as possible so that the alkali metal ion is not detached from the fiber. In view of the above, the manufacturing method according to the present invention is characterized in that a spinning dope comprising a polymer mixture of the above-mentioned acrylonitrile polymer and acrylic antistatic resin is subjected to wet spinning by a conventional method and after the resulting fiber is washed with water and drafted, the fiber before densification is treated with an aqueous solution of alkali metal salt and then densified.

In the fiber before densification, voids are present in the fiber and the alkali metal ion is able to be localized in the acrylic antistatic resin in the fiber by means of said voids. As a result of densification after that, detachment of the alkali metal ion in the fiber, or particularly, the alkali metal ion localized in the acrylic antistatic resin, is suppressed, whereby durability in dyeing and washing is enhanced to give sufficient antistatic property.

During the manufacture of the acrylic fiber, there are some cases where after the drafting step, the primary densification at high temperature and with conditioned moisture or the wet heat treatment under a relaxed condition is conducted. However, unlike such treatments, densification treatment according to the present invention stands for dry-densification by means of dry heat and wet-densification using steam or hot water at a temperature higher than the primary densification or wet heat treatment. In the densification treatment as such, a drier such as hot air drier or roller drier and a pressurizing container such as an autoclave or Obermaier dyeing machine may be used.

In the manufacturing method of the present invention, there is no particular limitation for a treating method using an aqueous solution of alkali metal salt and examples thereof include a method where the fiber is dipped in a treating vessel to which a target amount of the alkali metal salt to be contained in the fiber is added and squeezed to a predetermined extent using a press roller or the like, a method where an aqueous solution of the alkali metal salt is applied by means of spraying and a method where a treatment is conducted by a dipping means using an Obermaier dyeing machine or the like. The treatment with the aqueous solution of the alkali metal salt may be done at any time before the densification and it is also possible to do that even to the fiber in the so-called gel swelling state before the draft or to the fiber after the primary densification treatment or the wet heat treatment.

An example of the formulation of the fiber after the primary densification treatment utilizing a crimper preheating vessel or the like is as follows. Thus, a treating solution to which a target amount of the alkali metal salt to be adsorbed in tow or filament is added, is poured into a crimper preheating vessel, the tow or the filament is dipped in said treating solution, the predetermined squeezing is conducted utilizing the crimper or the like so that the target amount of the alkali metal ion is contained in the tow or the filament, and after that, a wet heat treatment and a densification treatment are carried out to sequester the alkali metal ion.

An example of the formulation where an Obermaier dyeing machine is utilized for the fiber after the wet heat treatment is as follows. Thus, a treating solution to which a target amount of the alkali metal salt to be adsorbed in tow or filament is added, is poured into a dyeing machine, the tow or the filament is dipped into said treating solution to conduct the treatment so that the target amount of the alkali metal ion is contained in the tow or the filament and, after that, the temperature of said treating solution is raised to conduct a wet densification treatment in a high-temperature treating solution whereby the alkali metal ion is sequestered. After that, a spinning oiling agent is applied thereto if necessary and drying is conducted using a hot air drier or the like.

An example of the formulation where an oiling vessel is utilized for the fiber after the wet heat treatment is as follows. Thus, a treating solution to which a target amount of the alkali metal salt to be adsorbed in tow or filament is added, is poured into an oiling vessel, the tow or the filament is dipped in said treating solution and squeezed to a predetermined extent using a nip roller or the like so that the target amount of the alkali metal ion is contained in the tow or the filament, a spinning oiling agent is applied if necessary and after that, a dry densification treatment is carried out whereby the alkali metal ion is sequestered.

As a result of conducting such a method, there is prepared an antistatic fiber having an excellent dyeing durability and since it is more preferred that the alkali metal ion is localized as much as possible in the acrylic antistatic resin in the fiber, it is desirable to have a structure wherein the fiber to be treated with an aqueous solution of alkali metal salt has hydrophilic microvoids and that each microvoid is connected with each other in the inner area of the fiber and communicates with the outside surface. As a result of making into such a structure, the aqueous solution of an alkali metal salt is able to effectively permeate into the inner area of the fiber using a capillary phenomenon. After that, a densification step is carried out for sequestering the microvoids and when such a densification is conducted under tension, better durability is achieved to give a fiber having far better antistatic property than a conventional antistatic fiber. Since the microvoids are apt to be crushed under a wet state, a wet densification is also an effective means. Said method will be illustrated by way of an example, where a method using an inorganic salt such as sodium thiocyanate as a solvent is disclosed.

Firstly, after an acrylonitrile polymer is dissolved, an acrylic antistatic resin is added thereto and mixed therewith either directly or as an aqueous dispersion, the resulting spinning dope is spun via nozzles, then subjected to the steps for coagulation, washing with water and draft, and the water content of the un-dried fiber after the draft is made 50 to 130% by weight, preferably 60 to 120% by weight. After that, a wet heat treatment is carried out at a temperature of 100° C. to 130° C., preferably 105° C. to 115° C. When the water content of the un-dried fiber after the draft is less than the above-mentioned range, it is not possible to connect the microvoids with each other in the inner area of the fiber and to communicate with the fiber surface; when the water content exceeds the above-mentioned range, many large voids are formed in the inner area of the fiber, whereby a spinning property is deteriorated and that is not preferred. Although there are many methods for controlling the water content of the un-dried fiber after the draft, it is preferred that the coagulating bath temperature is made about 0° C. to 15° C. and the draft rate is made about 7 to 15-fold for adjusting to the above-mentioned range. When the wet heat treatment is done at a temperature below the above-mentioned range, it is not possible to prepare a thermally stable fiber; when the temperature exceeds the above-mentioned range, there may be cases where microvoids for sufficient permeation of the alkali metal ion by a treatment in a short time, which will be mentioned later, are lacking. Hereinabove, the phrase "wet heat treatment" stands for a treatment where heating is carried out under the atmosphere of saturated steam or superheated steam.

After that, the tow or the filament prepared as such is treated with an aqueous solution of alkali metal salt so that the alkali metal ion is contained therein. There is no particular limitation for a method therefor but any of the above-mentioned methods may be used. In order to permeate the alkali metal ion into the inner area of the fiber, it is desirable to conduct the treatment at 60 to 100° C., preferably at 80 to 98° C. for 1 to 30 minute (s).

As to the condition for the densification treatment, any condition will do provided that the temperature therefor is higher than that for the primary densification treatment and the wet heat treatment and to be more specific, it is desirable that the heating treatment is done at 110° C. to 210° C., preferably at 120° C. to 210° C. More preferably, the treatment is conducted under tension using a roller drier or the like or under a wet state. When a heating treatment is conducted at the temperature of 110° C. or higher, the microvoids existing in the fiber are closed and the alkali metal ion is sealed into the inner area of the fiber whereupon the durability against detachment is improved. In the case of a porous substance, static electricity is apt to be generated, resulting in a problem that the handling upon processing is difficult, but when the microvoids are closed, an antistatic fiber having a smooth surface is prepared, wherein static electricity is hardly generated and the handling upon processing is easy.

If further necessary, an after-treatment such as crimping or cutting is conducted after the densification treatment to give the antistatic acrylic fiber of the present invention. There is no particular limitation for the spinning oiling agent provided that it is a spinning oiling agent for acrylic fiber.

There is no problem at all in adding a known additive to the fiber of the present invention. For example, an additive such as flame retardant, light resisting agent, ultraviolet absorber or pigment may be used.

The antistatic acrylic fiber of the present invention contains not less than 150 ppm of metal ion therein, the alkali metal ion retentive rate of the fiber after dyeing with cationic dye as compared with that before the dyeing is not less than 40% and the alkali metal ion content after dyeing with cationic dye is not less than 80 ppm. Accordingly, in the fiber of the present invention, the antistatic property hardly lowers even after repeated washings of the final product, because it is a permanently antistatic acrylic fiber.

The present invention relates to a fiber structure which at least partially contains an antistatic acrylic fiber. The fiber structure of the present invention exhibits such an excellent antistatic property that, after dyeing with cationic dye, the half-life of the friction-charged electrostatic potential is not longer than 3 seconds and friction-charged electrostatic potential is not higher than 2 kV, and such fiber also exhibits such a highly durable antistatic property that, even after washing for five times, the half-life of friction-charged electrostatic potential is not longer than 3 seconds and the friction-charged electrostatic potential is not higher than 2 kV.

Blending ratio of the above antistatic acrylic fiber in the fiber structure of the present invention may be appropriately set depending upon the antistatic property required for the final fiber product, and although there is no particular limitation therefor, it is not less than 1% by weight, preferably not less than 5% by weight, and more preferably not less than 10% by weight.

There is no particular limitation for other fiber which is blended with the antistatic acrylic fiber in the fiber structure of the present invention but natural fiber, organic fiber, semi-synthetic fiber and synthetic fiber may be used and, further, inorganic fiber, glass fiber, etc. may be used as well depending upon the particular use. Examples of the particularly preferred fiber include natural fiber such as wool, cotton, silk or hemp; synthetic fiber such as Vinylon, polyester, polyamide or acrylic fiber; viscose; acetate fiber; and cellulose fiber.

The antistatic acrylic fiber and the fiber structure in accordance with the present invention can be used in various fields where antistatic property is demanded, for example, they are able to be used in clothing in general such as for underwear, undershirt, lingerie, pajama, wear for infants, girdle, brassier, socks/stockings, tights, leotards or trunks; clothing for inner or outer use such as sweater, trainer, suit, sportswear, scarf, handkerchief, muffler, artificial leather and wear for suckling; hygienic materials such as bedding material, bed clothes, pillow, cushion, stuffed thing, mask, panties for incontinence or wet tissue; car materials such as car sheet or car interior; toilet goods such as toilet cover, toilet mattress or toilet for pets; materials for gas-treating filter or bug filter; insole for shoes; slippers; gloves; towel; duster; supporter; and non-woven fabric.

EXAMPLES

The present invention will now be specifically illustrated by using the following Examples although the present invention is not limited thereto. The terms "part (s)" and "percent (s)" used in the Examples are those by weight unless otherwise stipulated. Dyeing condition, washing condition and measuring method for characteristic values mentioned in the Examples are as follows.

(1) Dyeing Condition

A dyeing solution with 0.02% cationic dye (Cath. Red 7BNH manufactured by Hodogaya Chemical Co., Ltd.), 1.8% cationic retarding agent of a quaternary ammonium salt type (Astragal PAN manufactured by Bayer), 2% acetic acid and 1% sodium acetate was made with respect to the weight of the fiber, and was heated up to 60° C. A sample fiber was poured into this dyeing solution and heated up to 100° C. within 20 minutes with stirring. After that, dyeing was conducted for 30 minutes keeping the state of 100° C. followed by gradual cooling, washing with water and drying.

(2) Measurement of Alkali Metal Ion Content

An acid decomposition of the fiber which had been subjected to treatment with alkali metal salt was conducted and the amount of the alkali metal ion contained in the fiber was measured by an IPC emission spectrochemical analysis.

(3) Evaluation of Dyeing Property

The sample fiber was cut into a constant length of 51 mm, dipped in a dyeing bath containing 2% omf (% omf is a percentage to the fiber mass) of a cationic dye (Malachite Green) and 2% omf of acetic acid at 75° C. for 60 minutes and subjected to soaping, washing with water and drying. The resulting fiber (0.1 g) was dissolved in 25 ml of γ-butyrolactone and the absorbance (A) was measured by a spectrophotometer. On the other hand, 0.1 g of an acrylic fiber where 1% omf of cationic dye (Malachite Green) was completely absorbed by means of boiling was dissolved in 25 ml of γ-butyrolactone and its absorbance (B) was measured by a spectrophotometer. The above measured values were substituted into the following formula to calculate the dye saturation value. The higher the dye saturation value, the better, although it is said to be satisfactory at 1.5 or more.

$$\text{Dye saturation value}(\%\ omf)=A/B$$

(4) Measurement of a Volume Resistivity

Fineness (called T tex) and specific gravity (d) of the fiber were previously measured by a conventional method. After that, the fiber was subjected to a scoring treatment in a 0.1% aqueous solution of Neugen HC at 60° C. for 30 minutes where a bath ratio was 1:100, washed with running water and dried at 70° C. for 1 hour. The fiber was cut into a size of about 6 to 7 cm and allowed to stand for 3 hours or longer in an atmosphere where temperature was 20° C. and relative humidity was 65%. Each five of the resulting fibers (filaments) were bundled and an electroconductive adhesive was applied to an extent of about 5 mm on one end of the fiber bundle. Under the state where a load of 900 mg/tex was applied to this fiber bundle, the above electroconductive adhesive was applied to the position which is about 5 cm apart from the position to which the electroconductive adhesive was applied (the distance between the positions to which the electroconductive adhesives were applied was called L (cm)) to prepare a measuring sample. Under the state where the load of 900 mg/tex was applied to said measuring sample, electrodes were connected to the areas to which the electroconductive adhesives were applied, resistance R (Ω) when direct current (500 V) was applied was measured by using High RESISTANCE METER 4329A (manufactured by YOKOGAWA-HEWLETT-PACKARD) and a volume resistivity was calculated from the following formula.

$$\text{Volume resistivity}(\Omega\cdot\text{cm})=(R\times T\times 10^{-5})/(L\times d)$$

(5) Washing Condition

In accordance with Method 103 (for washing machines for domestic use) of JIS-L-0217, a sample knitted web was repeatedly washed for five times using Attack (manufactured by Kao) as a detergent.

(6) Measurement of Friction-Charged Electrostatic Potential

In accordance with JIS-L-1094 (method for the measurement of friction-charged electrostatic potential), a rotary static tester of the Institute of Chemical Research, Kyoto University (manufactured by Koa Co., Ltd.) was used and friction-charged electrostatic potential of the sample knitted web after dyeing and that after washings for five times after dyeing were evaluated. The voltage applied by the static honestmeter was 1000 volts, applying time was 30 seconds and sample revolution was 1000 rpm.

(7) Measurement of Half-Life of the Friction-Charged Electrostatic Potential

In accordance with JIS-L-1094 (method for the measurement of friction-charged electrostatic potential), a static honestmeter (manufactured by Shishido Electrostatic, Ltd.) was used and friction-charged electrostatic potential of the sample knitted web after dyeing and that after washings for five times after dyeing were evaluated. The drum revolution of the rotary static tester was 400 rpm and friction time was 60 seconds, and cotton was used as the cloth for the friction.

(8) Measurement of Water Content of the Un-Dried Fiber After Draft

After draft, the un-dried fiber before the wet heat treatment was dipped in pure water and then dehydrated with a centrifugal dehydrating machine (TYPE H-770A manufactured by Kokusan Co., Ltd.) for 2 minutes at the centrifugal rate of acceleration of 1100 G (G stands for gravitational rate of acceleration). After the dehydration, its weight (called W3) was measured, then said un-dried fiber was dried at 120° C. for 15 minutes, the weight thereof (called W2) was measured and calculation was conducted according to the following formula.

$$\text{Water content of the un-dried fiber after draft}(\%)=(W3-W2)/W2\times 100$$

Example 1

Acrylonitrile (90% by weight), 9% by weight of methyl acrylate and 1% by weight of sodium metallylsulfonate were subjected to an aqueous suspension polymerization to prepare an acrylonitrile polymer. Further, 30% by weight of acrylonitrile and 70% by weight of methoxypolyethylene glycol methacrylate were subjected to an aqueous suspension polymerization to prepare an acrylic antistatic resin. The acrylonitrile polymer was dissolved in an aqueous solution of sodium thiocyanate (concentration: 45% by weight) and then an aqueous dispersion of the acrylic antistatic resin was added thereto and mixed therewith to prepare a spinning dope in which the ratio by weight of the acrylonitrile polymer to the acrylic antistatic resin was 95:5. Said dope was extruded into a 15% by weight aqueous solution of sodium thiocyanate of 1.5° C. and the resulting fiber was washed with water and drafted to an extent of 12-fold to prepare a material fiber of 1.7 dtex. This material fiber was dipped in a 10% by weight bath of lithium perchlorate, treated at 80° C. for 1 minute, squeezed to a predetermined degree using a nip roller, subjected to a wet heat treatment using steam of 110° C. for 10 minutes and dry-densified using a hot-air drier of 120° C. to prepare an antistatic acrylic fiber. Details of the constitution of the antistatic acrylic fiber of Example 1 and evaluated result thereof are shown in Table 1.

Example 2

The same operation as in Example 1 was carried out except that the composition of the acrylonitrile polymer was changed to 88% by weight of acrylonitrile and 12% by weight of vinyl acetate while the composition of the acrylic antistatic resin was changed to 30% by weight of acrylonitrile, 12% by weight of 2-methacryloyloxyethyl isocyanate and 58% by weight of polyethylene glycol monomethyl ether to prepare a material fiber. This material fiber was dipped in a 10% by weight bath of lithium perchlorate, treated at 80° C. for 1 minute, squeezed to a predetermined degree using a nip roller, subjected to a wet heat treatment using steam of 110° C. for 10 minutes and dry-densified using a hot-air drier of 120° C. to prepare an antistatic acrylic fiber. Details of the constitution of the antistatic acrylic fiber of Example 2 and evaluated result thereof are shown in Table 1.

Example 3

The same spinning dope as in Example 1 was used, said dope was extruded into a 15% by weight aqueous solution of sodium thiocyanate of 1.5° C. and the resulting fiber was washed with water, drafted to an extent of 12-fold and subjected to a wet heat treatment with steam of 110° C. for 10 minutes to prepare a material fiber. This material fiber was dipped in a 0.03% by weight bath of lithium perchlorate, treated at 98° C. for 30 minutes, squeezed to a predetermined degree using a nip roller, and dry-densified using a roller drier of 130° C. to prepare an antistatic acrylic fiber. Details of the constitution of the antistatic acrylic fiber of Example 3 and evaluated result thereof are shown in Table 1.

Example 4

The same operation as in Example 3 was carried out except that the composition of the acrylonitrile polymer was changed to 88% by weight of acrylonitrile and 12% by weight of vinyl acetate to prepare a material fiber. This material fiber was dipped in a 0.03% by weight bath of lithium perchlorate, treated at 98° C. for 30 minutes, squeezed to a predetermined degree using a nip roller, and dry-densified using a roller drier of 130° C. to prepare an antistatic acrylic fiber. Details of the constitution of the antistatic acrylic fiber of Example 4 and evaluated result thereof are shown in Table 1.

Example 5

The same operation as in Example 4 was carried out to prepare a material fiber. This material fiber was dipped in a 0.1% by weight bath of lithium perchlorate, treated at 98° C. for 1 minute, subjected to a wet heat treatment using steam of 120° C. for 10 minutes for wet densification, and then dried using a hot-air drier to prepare an antistatic acrylic fiber. Details of the constitution of the antistatic acrylic fiber of Example 5 and evaluated result thereof are shown in Table 1.

Example 6

The same operation as in Example 4 was carried out to prepare a material fiber. This material fiber was dipped in a 0.03% by weight bath of lithium perchlorate, treated at 98° C. for 10 minutes, wet-densified in a treating solution of 120° C. for additional 10 minutes, and then dried using a hot-air drier to prepare an antistatic acrylic fiber. Details of the constitution of the antistatic acrylic fiber of Example 6 and evaluated result thereof are shown in Table 1.

Example 7

The same operation as in Example 3 was carried out except that dry-densification was conducted at 170° C. under a state where the speed between the rollers of a roller drying machine was changed so as to give tension to the fiber whereupon an antistatic acrylic fiber was prepared. Details of the constitution of the antistatic acrylic fiber of Example 7 and evaluated result thereof are shown in Table 1.

Example 8

The same operation as in Example 4 was carried out except that dry-densification was conducted at 170° C. under a state where the speed between the rollers of a roller drying machine was changed so as to give tension to the fiber whereupon an antistatic acrylic fiber was prepared. Details of the constitution of the antistatic acrylic fiber of Example 8 and evaluated result thereof are shown in Table 1.

Comparative Examples 1 and 2

Spinning dopes were prepared by the same method as mentioned in Examples 7 and 8, except that no acrylic antistatic resin was added and were subjected to spinning, and no treatment with alkali metal salt and dry-densification under tension were performed to prepare acrylic fibers of Comparative Examples 1 and 2, respectively. Details of the constitution of the antistatic acrylic fibers of Comparative Examples 1 and 2 as well as evaluated result thereof are shown in Table 1.

Comparative Example 3

A spinning dope was prepared by adding 0.5% by weight of lithium perchlorate to the spinning dope of Example 1. Said spinning dope was extruded into a 15% by weight aqueous solution of sodium thiocyanate of 1.5° C. However, end breakage occurred and no spinning was possible.

TABLE 1

| | acrylonitrile polymer (% by weight) | antistatic resin (% by weight) | alkali metal ion content before dyeing (ppm) | alkali metal ion content after dyeing (ppm) | retentive rate (%) | dye saturation value | volume resistivity (Ω · cm) | water content of the un-dried fiber |
|---|---|---|---|---|---|---|---|---|
| Example 1 | 95 | 5 | 1400 | 140 | 10 | 1.78 | $5 \times 10^5$ | 73.5 |
| Example 2 | 95 | 5 | 1500 | 160 | 11 | 1.72 | $2 \times 10^5$ | 81.7 |
| Example 3 | 95 | 5 | 220 | 110 | 50 | 1.79 | $7 \times 10^5$ | 53.2 |
| Example 4 | 95 | 5 | 240 | 120 | 50 | 1.69 | $6 \times 10^5$ | 63.8 |
| Example 5 | 95 | 5 | 400 | 220 | 55 | 1.52 | $1 \times 10^5$ | 61.2 |
| Example 6 | 95 | 5 | 360 | 240 | 67 | 1.55 | $5 \times 10^4$ | 59.9 |
| Example 7 | 95 | 5 | 350 | 240 | 69 | 1.82 | $6 \times 10^4$ | 60.2 |
| Example 8 | 95 | 5 | 350 | 240 | 69 | 1.7 | $9 \times 10^3$ | 61.1 |
| Comparative Example 1 | 100 | 0 | 140 | 60 | 43 | 1.9 | $4 \times 10^{14}$ | 49.8 |
| Comparative Example 2 | 100 | 0 | 140 | 50 | 36 | 1.97 | $1 \times 10^{14}$ | 51.1 |
| Comparative Example 3 | 95 | 5 | no spinning was possible | | | | — | — |

As is apparent from Table 1, the retentive rates after dyeing were low in Examples 1 and 2 probably because of a small amount of alkali metal ion localized to the acrylic antistatic resin. However, since the initial contents were high, sufficient amounts of the alkali metal ion were retained even after dyeing. In Examples 3 and 4, although the initial contents of the alkali metal ion were small, both the retentive rate and the residual amount of the alkali metal ion after dyeing were good and the dyeing property was also good probably due to the fact that localization of the alkali metal ion to the acrylic antistatic resin was promoted by the formation of microvoids. In Examples 5 and 6, as a result of the wet densification, both the retentive rate and the residual amount of the alkali metal ion after dyeing were good and the dyeing property was good as well. In Examples 7 and 8, dry-densification was conducted under tension whereby detachment of the alkali metal ion was able to be kept at a minimum; both retentive rate and residual amount of the alkali metal ion after dyeing increased and the dyeing property was good as well. Volume resistivities for Examples 1 to 8 were within a level of $10^3$ to $10^6$ Ω·cm whereby the antistatic property was able to be achieved. In Comparative Examples 1 and 2, no acrylic antistatic resin was contained, amounts of the introduced alkali metal ion were small and both the retentive rate and the residual amount of the alkali metal ion after dyeing were also very low. Their volume resistivities were in a level of $10^{14}$ Ω·cm whereby the antistatic property was unable to be achieved. In Comparative Example 3, spinning was tried by addition of lithium perchlorate but the spinning dope was partly gelled and nozzle clogging and end breakage happened and thus good fiber was unable to be prepared.

Examples 9 to 16 and Comparative Examples 4 to 6

Spinning was carried out by a conventional method using the antistatic acrylic fibers of Examples 1 to 8 and Comparative Examples 1 to 2 to prepare an acrylic-blended and twisted yarn in various blending ratios where the yarn count was 1/48 and the twist numbers were 660. With regard to the fiber to be blended therewith, K8-1.7T51 (manufactured by Japan Exlan Co., Ltd.) which is a conventional acrylic fiber was used. Further, as a result of rib stitch with 14G2P, acrylic knitted web samples of Examples 9 to 16 and Comparative Examples 4 and 5 were prepared. Furthermore, a knitted web sample using 100% of K8-1.7T51 was prepared as Comparative Example 6. Details of the constitution of the woven cloth of Examples 9 to 16 and Comparative Examples 4 to 6 and evaluated results thereof are shown in Table 2.

TABLE 2

| | antistatic fiber | | half-life (sec.) | | friction-charged electrostatic potential (V) | |
|---|---|---|---|---|---|---|
| | fiber type | blending ratio (% by weight) | after dyeing | after washings for five times after dyeing | after dyeing | after washings for five times after dyeing |
| Example 9 | Example 1 | 10 | 1.6 | 2.1 | 1400 | 1700 |
| Example 10 | Example 2 | 10 | 1.3 | 1.9 | 1200 | 1700 |
| Example 11 | Example 3 | 10 | 1.9 | 2.8 | 1600 | 1900 |
| Example 12 | Example 4 | 10 | 1.6 | 2.6 | 1300 | 1800 |
| Example 13 | Example 5 | 10 | 1.2 | 1.8 | 880 | 1700 |
| Example 14 | Example 6 | 10 | 1.2 | 1.4 | 660 | 1700 |
| Example 15 | Example 7 | 10 | 0.8 | 1.8 | 690 | 1300 |
| Example 16 | Example 8 | 10 | 0.6 | 1.4 | 610 | 1100 |
| Comparative Example 4 | Comparative Example 1 | 100 | >180 | >180 | 4800 | 5200 |
| Comparative Example 5 | Comparative Example 2 | 100 | >180 | >180 | 4600 | 5000 |
| Comparative Example 6 | — | 0 | >180 | >180 | 4800 | 5300 |

As is apparent from Table 2, although the blending ratios were low in Examples 9 to 16, an excellent antistatic property was able to be achieved and durability thereof was also sufficient because the antistatic acrylic fiber was contained in the knitted web. On the contrary, in the knitted web of Comparative Examples 4 and 5 using the fibers of Comparative Examples 1 and 2 where no acrylic antistatic resin was contained in the fiber, the resulting antistatic property was the same as that in Comparative Example 6 using the conventional acrylic fiber only, in spite of the fact that the alkali metal ion is introduced (although the amount is not sufficient) into the fibers of Comparative Examples 1 and 2 whereupon the resulting knitted web was unable to have an antistatic property.

The invention claimed is:

1. An antistatic acrylic fiber which comprises 90 to 99% by weight of acrylonitrile polymer containing 80 to 100% by weight of acrylonitrile as a constituting component and 10 to 1% by weight of acrylic antistatic resin containing 10 to 70% by weight of acrylonitrile as a constituting component, wherein alkali metal ion is contained in an amount of not less than 150 ppm to the fiber.

2. The antistatic acrylic fiber according to claim 1, characterized in that the volume resistivity is from $10^3$ to $10^6$ Ω·cm.

3. The antistatic acrylic fiber according to claim 1, characterized in that the acrylic antistatic resin is an acrylic polymer containing 90 to 30% by weight of the copolymerizing component represented by the following formula [I] as a constituting component and that the alkali metal ion is lithium ion:

[I]

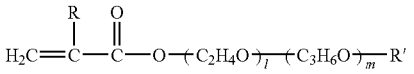

wherein R is hydrogen atom or alkyl group having 1 to 5 carbon(s); R' is hydrogen atom, alkyl group having 1 to 18 carbon(s), phenyl group or derivative thereof; 15<1<50; and 0≦m<1.

4. The antistatic acrylic fiber according to claim 1, characterized in that the alkali metal ion retentive rate of the fiber after being dyed with cationic dye to that before being dyed is not less than 40%.

5. The antistatic acrylic fiber according to claim 4, characterized in that the alkali metal ion content to the fiber after being dyed with cationic dye is not less than 80 ppm.

6. An antistatic fiber structure which is characterized in containing the antistatic acrylic fiber according to claim 1 at least partially.

7. The antistatic fiber structure according to claim 6, characterized in that, after being dyed with cationic dye, half-life of the friction-charged electrostatic potential is not more than 3 seconds and the friction-charged electrostatic potential is not more than 2 kV.

8. A method for the manufacture of an antistatic acrylic fiber, characterized in that a spinning dope containing a polymer mixture which comprises 90 to 99% by weight of acrylonitrile polymer containing 80 to 100% by weight of acrylonitrile as a constituting component and 10 to 1% by weight of acrylic antistatic resin containing 10 to 70% by weight of acrylonitrile as a constituting component is subjected to a wet spinning and, after the resulting fiber is washed with water and drafted, it is treated with an aqueous solution of alkali metal salt and then densified.

9. The method for the manufacture of an antistatic acrylic fiber according to claim 8, characterized in that the water content of the un-dried fiber after washing with water and being drafted is 50 to 130% by weight and that a thermal treatment is conducted at the temperature of 100 to 130° C. between the treatment of washing with water and being drafted and the treatment with an aqueous solution of alkali metal salt.

10. The method for the manufacture of an antistatic acrylic fiber according to claim 8, characterized in that the densification treatment is conducted under tension.

11. The method for the manufacture of an antistatic acrylic fiber according to claim 8, characterized in that the densification treatment is conducted in a wet state.

* * * * *